United States Patent [19]

Armstrong

[11] 4,283,982

[45] Aug. 18, 1981

[54] MAGNETIC PICKUP FOR ELECTRIC GUITARS

[76] Inventor: Daniel K. Armstrong, 710 Marguerita, Santa Monica, Calif. 90402

[21] Appl. No.: 6,929

[22] Filed: Jan. 26, 1979

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 2,911,871 | 11/1959 | Schultz | 84/1.15 |
| 3,249,677 | 5/1966 | Burns et al. | 84/1.16 |
| 3,571,483 | 3/1971 | Davidson | 84/1.16 |
| 3,588,311 | 6/1971 | Zoller | 84/1.15 |
| 3,657,461 | 4/1972 | Freeman | 84/1.15 |
| 3,711,619 | 1/1973 | Jones et al. | 84/1.15 |
| 3,916,751 | 11/1975 | Stich | 84/1.15 |
| 3,983,777 | 10/1976 | Bartolini | 84/1.15 |

*Primary Examiner*—S. J. Witkowski

[57] ABSTRACT

A magnetic pickup for a stringed musical instrument, comprising a polar magnet having a polar axis extending across its thinnest dimension, a coil having a magnetically permeable pole piece extending upwardly for positioning adjacent an instrument string, with the polar magnet positioned longitudinally parallel to the coil and having its polar axis perpendicular to the winding axis of the coil. Positioned within the coil is either a magnet or a pole piece. The pickup may include a plurality of coils and magnets arranged as described above to increase the effectiveness of the pickup. Also disclosed is a method for manufacturing the pickup which includes setting the pole piece, coil, magnet, and mounting bracket in a mold cavity, and casting the entire unit with potting material.

13 Claims, 6 Drawing Figures

MAGNETIC PICKUP FOR ELECTRIC GUITARS

BACKGROUND OF THE INVENTION

The present invention relates to a magnetic pickup for a stringed musical instrument, such as an electric guitar.

Conventional pickup devices utilize a magnet and coil combination arranged such that a magnetic flux field pattern is created around the pickup. When mounted near the vibrating string of a musical instrument, the string motion is sensed by the field and translated into an electrical signal for amplification.

One example of a pickup device is illustrated in the patent to Zoller, U.S. Pat. No. 3,588,311, in which polar magnets are positioned inside and adjacent the coil such that the polar axes of the magnets are perpendicular to each other. Another configuration is disclosed in the patent to Schultz, U.S. Pat. No. 2,911,871, having polar magnets positioned beneath a coil, with the south poles of the magnets facing each other.

Another pickup structure currently in use involves the use of a flattened rectangular bar magnet having a height of approximately one half its width, with its polar axis extending across the width dimension. The magnet is positioned between two longitudinally parallel coils, each coil having a height approximately equivalent its width.

Difficulties have been encountered with such conventional pickup structures in attempting to reproduce true and undistorted sound from the musical instrument. Conventional pickups have a problem creating a strong and properly shaped magnetic field which enhances the ability of the pickup to reproduce the natural tone of the vibrating string. Merely increasing the size or strength of the magnetic pickup without attention to the shape and arrangement of the coil and magnet elements presents complications in that an over-sensitive device may pick up unwanted noise apart from the desired music, and may also increase the presence of feedback.

It is therefore an object of the present invention to construct a magnetic pickup which produces a signal allowing for amplification of the natural full tones of a stringed musical instrument. It is an object of the present invention that there be faithful reproduction of the fundamental tone as well as any harmonic overtones.

It is an object of the present invention to provide a pickup that produces a stronger magnetic field for sensing a vibrating string element. This includes producing a magnetic field having more flux lines extending in a suitable pattern to encompass string vibrations, and thus pick up the maximum vibrations to produce a maximum signal for amplication. It is also an object of the present invention to minimize the distortion present in the signal produced by the vibrating string.

It is a further object of the present invention to provide a magnetic pickup which is inexpensive, and which has simple components to increase the life and durability of the device.

It is an object of the present invention to provide an improved method of constructing a pickup to minimize manufacturing labor and material costs. Another object is that the method of construction involves simple and easy assembly of components.

SUMMARY OF THE INVENTION

The magnetic pickup for a stringed musical instrument disclosed in the present invention includes a polar magnet having its polar axis extending across the thinnest dimension of the magnet, and a coil having a magnetically permeable pole piece extending upwardly toward an instrument string. The magnet is positioned longitudinally parallel to the coil with the polar axis of the magnet perpendicular to the winding axis of the coil. The device may be constructed using one or more magnets arranged with one or more coils, and has either a magnet or a pole piece positioned within the coil. Various embodiments include one magnet arranged between two coils, one coil between two magnets having like poles facing opposite each other, and two coils arranged between two magnets having unlike poles facing opposite each other. Another embodiment utilizes two coils arranged with three magnets having like poles facing opposite each other, with a first coil positioned between the first and second magnet, and a second coil positioned between the second and third magnet.

In the method of constructing the magnetic pickup device, the pole piece elements are placed in a mold cavity over which a shallow layer of potting material is poured to provide a base for placing the coil and magnet elements in position within the mold. After placing a mounting bracket element over the coil and magnet elements, the entire unit is casted with potting material.

DESCRIPTION OF THE PREFERRED EMBODIMENT

Figure 1:
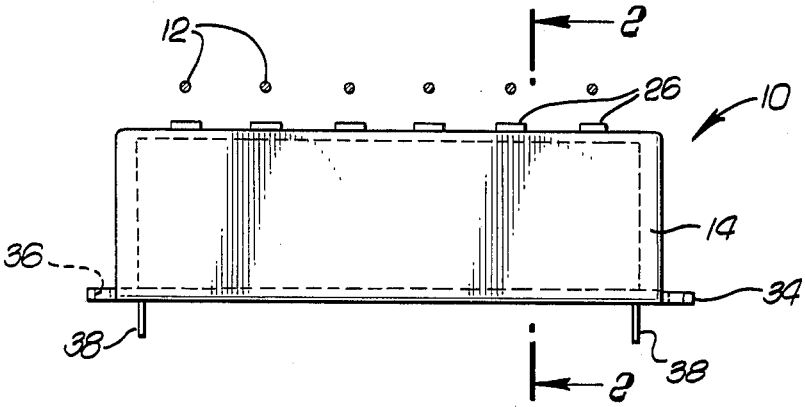
FIG. 1 is a side view of a magnetic pickup incorporating the presently preferred embodiment of the invention and positioned beneath the strings of a musical instrument.
Figure 2:
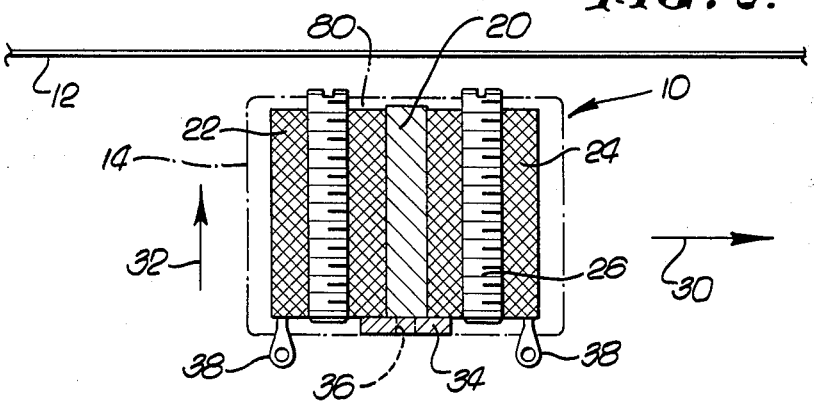
FIG. 2 is a sectional view taken along the line 2—2 of FIG. 1.
Figure 3:
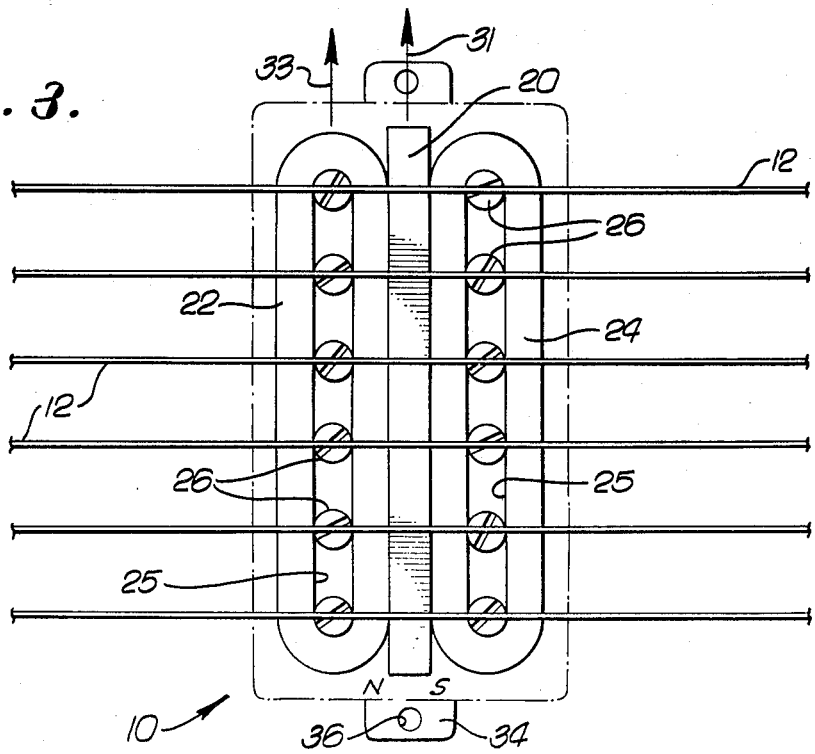
FIG. 3 is a top view of the pickup shown in FIG. 1.

Referring to FIGS. 1–3, the pickup 10 is mounted beneath the strings 12 of a musical instrument. The pickup has a casing 14 of potted material for housing a magnet 20 and coils 22 and 24. Each coil has a hollow center 25. In the embodiment shown, the pole pieces 26 are magnetically permeable screws positioned within the hollow center under each string which allow individual adjustment of the distance between the top of the screw and the string. The adjusting screws are not permanently magnetized, and serve as elongate cores or pole pieces. The magnet 20 has a polar axis in the direction of line 30, and a longitudinal axis in the direction of the line 31 (FIGS. 2 and 3). The coils each have a winding axis in direction of line 32 and a longitudinal axis in direction of line 33.

The magnet is positioned adjacent the coils with the longitudinal magnet axis 31 parallel to the longitudinal coil axis 33. In addition, the polar axis 30 of the magnet is perpendicular to the winding axis 32 of each coil.

A distinguishing feature of the present invention is that the magnet 20 has its polar axis extending across its thinnest cross-sectional dimension. In the preferred embodiment shown, the magnet has a cross-sectional height of at least one-third greater than the width. Thus, the width is the thinnest cross-sectional dimension across which the polar axis of the magnet must be situated. A further characteristic of the preferred embodiment is that the coil has a height greater than the width, typically at least 1.5 times greater. In addition, the magnet is preferrably a ceramic magnet which exhibits better characteristics over conventional alnico magnets.

A mounting plate 34 of nonmagnetic material and having threaded holes 36 for mounting the pickup on a musical instrument body, is situated on the under side of the pickup. Two terminals 38 are attached to each end of the wire comprising each coil and extend outwardly from the bottom of the pickup.

In operation, a string is plucked creating vibrations which disturb the magnetic field generated by the arrangement of the magnet and coils. The resulting electric signal at the terminals 38 is transmitted to an amplifier and speaker. By adjusting the height of the pole piece adjusting screws, the screw can be positioned closer to or further from the string to vary the amplitude and wave form of the signal as required. It should be noted that the coil is shaped such that the curved end portions of the coil extend outwardly beyond the pickup area under the strings.

Figure 4:
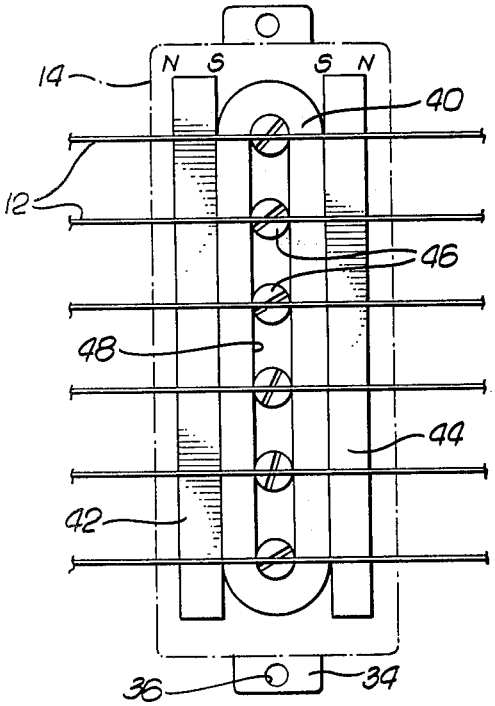
FIGS. 4, 5, and 6 are top views similar to that shown in FIG. 3 showing various alternative embodiments of the invention.

FIG. 4 shows another embodiment having a single coil 40 arranged between two permanent magnets 42 and 44 having like poles (in this case south poles) facing opposite each other on either side of the coil. The pole pieces 46 are conventional adjusting screws positioned in the hollow center 48 of coil 40.

Figure 5:
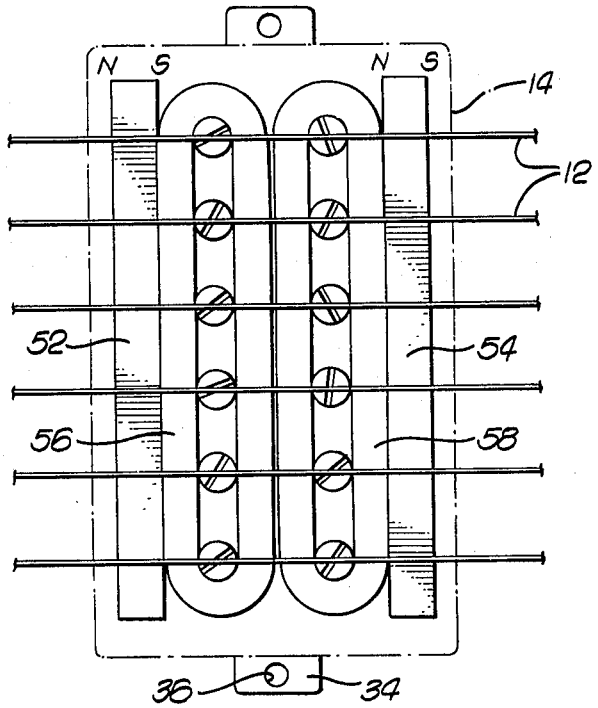

FIG. 5 discloses another embodiment having two longitudinally parallel adjacent coils 56, 58 positioned between two magnets 52, 54. The polar axis of each magnet is perpendicular to the winding axis of each coil. In addition, the magnets are positioned having unlike poles facing opposite each other.

Figure 6:
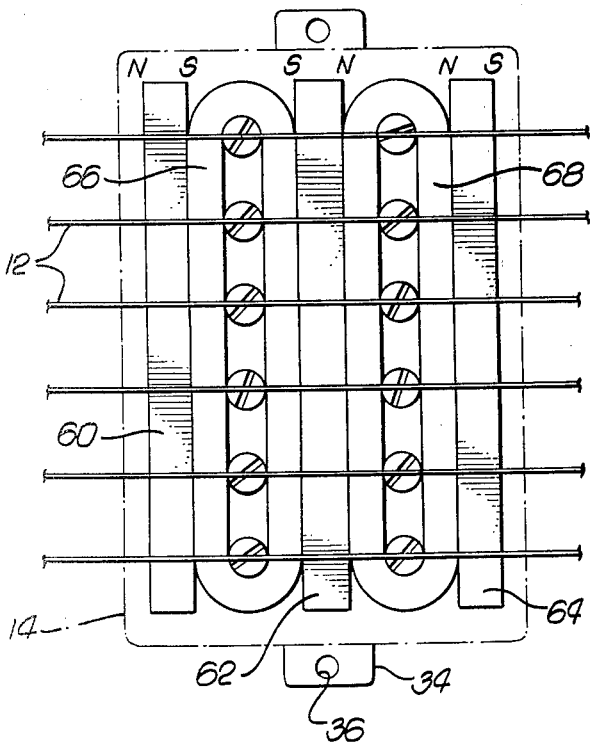

FIG. 6 discloses another embodiment having three magnets 60, 62, 64 positioned with two parallel coils 66, 68. The magnets are arranged such that like poles of each magnet face opposite each other, with a coil positioned between each pair of magnets.

It should be noted that in each of these embodiments the magnets are polarized such that the magnetic flux lines extend across the thinnest cross-sectional dimension of each magnet. Furthermore, the magnets are positioned with the polar axis line of the magnet or magnets perpendicular to the winding axis of each coil.

In the preferred method for constructing the magnetic pickup, the pole piece elements 26 are set upright in a mold cavity. The mold is positioned upside down with respect to the orientation of the pickup shown in FIG. 1. In a typical embodiment the pole piece elements are set upright in the mold. They may be adjustable screws which are threaded into the bottom of the mold cavity to remain in position for the subsequent steps. Next, a shallow layer of potting is poured into the mold cavity to provide a base layer 70 (FIG. 3). The coil and magnet elements are placed in position within the mold upon this base layer.

The mounting bracket plate 34 with mounting holes 36 is then positioned on top of the magnet and coil arrangement. The depth of the mold is such that the lugs 38 attached to the coils protrude from the base of the mold. The last step is to cast the entire unit with potting material, thus firmly fixing the magnet and coils in position within the pickup device. The finished unit may then be removed from the mold. The screws make their own threads in the potting material. An important feature of the present construction is that bobbinless coils are used. This permits the pole pieces or magnet depending on which construction is used, to substantially fill the center of the coils, with a minimum amount of non-magnetic material therebetween.

I claim:

1. A magnetic pickup for a stringed musical instrument, comprising in combination:

a polar bar magnet having a longitudinal axis, a vertical axis, and a transverse polar axis extending across the thinnest cross-sectional dimension of said magnet;

a coil having a winding axis and a hollow center;

a magnetically permeable pole piece separate from said magnet and extending upwardly parallel to said magnet vertical axis for positioning adjacent an instrument string; and with said magnet positioned longitudinally parallel to said coil having said polar axis perpendicular to the winding axis of said coil so that the only magnetic field in the pickup is that provided by said magnet along said transverse polar axis, with one of said magnet and pole piece placed within said hollow center of said coil and with the other of said magnet and pole piece placed outside said coil with the field from said magnet entering said pole piece through said coil.

2. A magnetic pickup as defined in claim 1 wherein said magnet has a cross-sectional height along said vertical axis of at least two times the width, with said polar axis extending across said width.

3. A magnetic pickup as defined in claim 2 wherein said magnet is a ceramic magnet.

4. A magnetic pickup as defined in claim 3 including means for housing and mounting said magnet and coil.

5. A magnetic pickup as defined in claim 4 including means for connecting said pickup to an electronic amplification system.

6. A magnetic pickup as defined in claim 5 wherein said pole piece comprises at least one screw for adjusting the distance between said screw and said instrument string.

7. A magnetic pickup as defined in claim 1 including a second coil, with said one and second coils having parallel winding axes, and said magnet positioned between said coils, with said pole piece extending through said one coil, and with a second separate pole piece extending through said second coil.

8. A magnetic pickup as defined in claim 1 including a second magnet, with said one and second magnets having parallel longitudinal axes and having like poles facing each other, and said coil is placed between said magnets, with said pole piece positioned within said hollow coil.

9. A magnetic pickup as defined in claim 1 including a second magnet, with said one and second magnets having unlike poles facing each other, and including a second coil, with said one and second coils having parallel winding axes placed between said magnets, with said pole piece positioned within said one coil, and with a second separate pole piece positioned within said second coil.

10. A magnetic pickup as defined in claim 1 including second and third magnets, with said one and second and third magnets having unlike poles facing each other, and including a second coil, with said one and second coils having parallel winding axes, with said one coil placed between said first and second magnets and said second coil placed between said second and third magnets, and with said pole piece positioned within said one coil, and with a second separate pole piece positioned within said second coil.

11. A magnetic pickup as defined in claim 1 wherein the cross-sectional height of said magnet is at least one-third greater than its width.

12. A magnetic pickup as defined in claim 11 wherein the coil has a height at least 1.5 times its width.

13. A magnetic pickup for a string instrument, comprising in combination:

a coil having a first winding axis and having a plurality of elongate cores positioned adjacent said coil parallel to each other and said first axis, and spaced from each other along a second axis perpendicular to said first axis; and a permanent bar magnet positioned adjacent said coil and having a magnetic field along a third axis substantially perpendicular to said first and second axes so that the only magnetic field in the pickup is that provided by said magnet along said third axis, with said cores separate from said magnet;

with said magnetic field through the smallest dimension of said magnet, and with one of said cores and magnet positioned within said coil and with the other of said cores and magnet positioned outside said coil with the field from said magnet entering said cores through said coil.

* * * * *